United States Patent [19]

Denikin et al.

[11] 4,018,541

[45] Apr. 19, 1977

[54] ROAD ROLLER FOR COMPACTING PAVEMENTS

[76] Inventors: Ernst Ivanovich Denikin, Grazhdansky prospekt, 13, korpus 1, kv. 190; Nikolai Yakovlevich Khazkhuta, prospekt Smirnova, 37, korpus 1, kv. 20; Alexandr Andreevich Shestopalov, prospekt Smirnova, 20, korpus 1, kv. 30; Vladimir Vachaganovich Badalov, Grazhdansky prospekt, 124, kv. 441, all of Leningrad; Alexandr Alexandrovich Vasiliev, Volzhsky bulvar, 40, kv. 36, Moscow; Vyacheslav Ivanovich Okunev, ulitsa Schepkina, 12, kv. 47; David Abramovich Kaplan, ulitsa Gertsena, 87, kv. 166, both of Rybinsk Yaroslavskoi oblasti; Jury Borisovich Deinego, ulitsa Druzhby, 2/19, kv. 199, Moscow; Alexandr Danilovich Kazakov, ulitsa 9 aprelya, 68, kv. 5, Kaliningrad; Vladimir Ivanovich Gienko, ulitsa Tovarnaya, 21a, kv. 4, Kaliningrad; Alexei Alexeevich Marchenko, ulitsa Sudostroitelnaya, 72, kv.6, Kaliningrad; Mikhail Avramovich Laevsky, Moskovsky prospekt, 148, kv.19, Kaliningrad, all of U.S.S.R.

[22] Filed: Dec. 4, 1975

[21] Appl. No.: 637,704

[52] U.S. Cl. ..... 404/130

[51] Int. Cl.[2] ..... E01C 19/26

[58] Field of Search ..... 404/103, 122, 130; 172/611

[56] References Cited

UNITED STATES PATENTS

| | | | |
|---|---|---|---|
| 2,276,713 | 3/1942 | Bramble | 404/122 |
| 3,665,822 | 3/1972 | Speer | 404/130 |

*Primary Examiner*—Henry S. Jaudon
*Attorney, Agent, or Firm*—Fleit & Jacobson

[57] ABSTRACT

A road roller comprises a ballast means made in the form of a chamber of gasproof material, said chamber having one side open and being provided with an end wall connected to a chassis of the road roller. The chamber communicates with a source of vacuum and is arranged so that, when vacuum is induced in the chamber, the pavement being compacted overlaps said open side of the chamber with the result that forces are transmitted from the chamber to the chassis of the road roller.

8 Claims, 8 Drawing Figures

ROAD ROLLER FOR COMPACTING PAVEMENTS

This invention relates to devices for compacting structural elements of pavements and, more particularly, to road rollers of static and vibration types which are used in road building or in other fields of industry dealing with construction works.

Most advantageously, the invention may be utilized in the field of highway engineering in the form of a static steel wheel roller which is used mainly for compacting structural layers of pavements made of asphalt or asphalt and concrete mixtures.

Still another and not less important field where the invention may find its use is vehicles and more particularly tractors, where the device of the invention may be utilized as means for increasing an adhesion weight.

The steady growth in production of surface vehicles caused by constantly increasing freight turn-over traffic causes one to place emphasis on road building.

Among many other factors defining the quality of the road being constructed, the principal ones are density and strength of its pavement, particularly, the structural layers made of asphalt or asphalt concrete (to be referred to hereinbelow as a paving mixture). While the strength of a pavement is characterized mainly by a number of technological factors inherent in the process of mixing the pavement material, the density of the pavement is defined only by the process of treating prefabricated pavement mixture directly on the road, i.e. the density is characterized by the mechanical compaction. Utilized as a rule, the purpose of the mechanical compaction is to produce a material of low porosity which, along with a physical strength of the pavement, may be considered as the main characteristic defining lifetime of the pavement during its usage. Where the porosity exceeds permissible limits, it may lead, in regions with abrupt changes of climatic conditions, particularly in Northern regions, to a rapid deterioration of the pavement and require additional expenses for repairs.

The main reason for damage is moisture penetrating into the pores of the pavement, this moisture which changes its volume depending on temperature thereby generates in the pavement material internal stresses complementary to service loads. In most cases, however, these internal stresses are the only reason for deterioration.

To achieve the minimum porosity and hence the maximum strength of the pavement material which in some degree depends on the former, it has been practicised to choose the compaction conditions so as to provide, in the pavement mixture applied on a road bed surface, predetermined ratio stresses produced under the action of compacting machines and the ultimate strength of this mixture. This ratio may be described as follows: $\sigma = 0.94 - 0.98\ \sigma_1$, wherein $\sigma$ is a current value of the stress and $\sigma_1$ is an ultimate strength of the pavement mixture.

An important circumstance which should be taken into account when compacting a pavement mixture is the fact that the pavement mixture is applied onto the road bed surface at temperatures of about 140° – 160° C, whereas in the course of compaction this temperature drops to that of the ambient atmosphere. The temperature decreases by an exponential law. In view of the above, the process of compaction appears to be rather laborious due to the fact that $\sigma_1$ varies depending on temperature with the result that it is necessary to control the value of $\sigma$ by constantly following the variation of $\sigma_1$ from above-given ratio. In other words, a force acting upon the pavement mixture being compacted should be continuously increased in accordance with the exponential law. A reasonable range of temperatures for a pavement mixture, where compaction is performed by loading the applied mixture according to the exponential law, comprises from 140° – 160° C. to 60° – 50° C.

In the construction of modern road compacting equipment, such as road rollers, there is a tendency to satisfy at a maximum rate the requirement to continuously increase the load acting upon the pavement mixture with constantly decreasing temperature. In accordance with the above practice, it is customary at present to use a method of compacting the pavement consisting in that the compaction is carried out with a number of rollers arranged in tandem having different weights beginning from light rollers at the initial stage and terminating in heavy rollers at the final stage. For the foregoing reasons, rollers are divided into three classes by weight; light weight class with the weight up to 5 *t*, medium weight class with the weight from 5 to 10 *t* and heavy weight class with the weight more than 10 *t*.

Though this classification is widely used, it is of rather conventional character. Further subdivision by weight is possible within each class. For example, rollers of the light weight class may be divided according to weights of 1.5 *t*, 3 *t*, 5 *t*, etc.

Thus, from 3 to 7 or more rollers of different weights may be used to carry out the above-described method of compaction.

Modern compaction technique per se is rather simple. However, it requires strict observation of time intervals for the operation of rollers in each weight catagory. This necessitates constantly measuring the pavement temperature with the resultant replacement, at the required moment, of one roller by another which is heavier. Along with the difficulties in determining the moment for replacing the rollers (and these difficulties at the present time may be principally obviated), it is practically impossible to ensure optimum rate of compaction by maintaining the ratio: $\sigma = 0.94 - 0.98\ \sigma_1$. It stems from the fact that the decrease of temperature progresses continuously and the roller has a constant weight. Thus, the exponential law in changing a load on the pavement is not observed. Therefore, one can see that the load applied to the pavement changes in steps.

Almost all of present-day rollers of static type, i.e. of those using their own weight for compacting an object (except for manually propelled tape) comprise a chassis in the form of a welded or riveted frame provided with compacting members, i.e. rolls, connected thereto through shock absorbers. The rolls comprise substantially cylindrical bodies of revolution in the form of generating surfaces which make it possible to subdivide the rollers of the static type into different types such as smooth rollers, pneumatic sheepsfoot rollers, grid rollers, disk rollers, segment-type rollers, etc. The main difference between the rollers of various types lies mainly in the form of their compacting member, whereas the remaining parts thereof are almost the same. Apart from the units mentioned above, road rollers contain an internal combustion engine which power is determined by the weight category of the roller. The engine is connected through a transmission to one or two rolls. A roller may be composed of a plurality of rolls, but from the structural and technological points of view the maximum number of rolls should be chosen from one to three.

Aside from the engine and transmission, the chassis carries a control unit a comprising steering system with a steering wheel arranged in a driver's cabin. The roller includes a further damping (moistening) unit for rolls. The structure of this latter unit will not be considered in this specification since there is no appreciable effect on the operation of the roller.

A ballast means is of particular importance for the structure of the road roller, since this unit comprises essentially the main unit of the machine and determines its efficiency. The purpose of the ballast means is to statically load the rolls in the course of the compacting operation. The structure of this unit is of crucial importance not only in the structure of the roller itself, but in choosing the required technology for making a pavement. Therefore, it is worth considering in detail the design of presently used ballast means, their relationship with and their effect on the operation of the road roller.

The most simple type of ballast means is a combination of individual units of a roller, said units being made with purposely increasing weights. In rollers with the above-described principles of ballasting, the rolls are made heavy of cast iron or they are provided with specially formed cavities filled with concrete in plastic a state which is then set in these cavities. The roller of the kind referred to above can apply to a pavement being compacted by a static load which is equal only to the weight of the roller itself, and this is the main disadvantage of the design. Nevertheless, the road rollers of this type are the most popular in the art.

More interesting, from the technological point of view, are road rollers with variable ballast means. A chassis of the roller mounts a special device to accommodate a removable ballast. The structures of the ballast means are classified in accordance with the type of ballast used. For example, if the ballast comprises bulk material such as sand or crushed stones, the ballast means is made in the form of a container which may be located at any place on the chassis.

In case of liquid ballast and particularly water, the ballast means is a reservoir provided with shut-off valves and mounted on the chassis by means of supports specially provided for this purpose.

The ballast in the form of separate units composed of building stones or metal determines the ballast means structure of a catridge type. The above-mentioned units are inserted in cells of the cartridge so as to be removed or loaded in a minimum time. In spite of the fact that the variable ballast means of this kind makes it possible to control the static load applied to the rolls, this method of control is inefficient by virtue of its stepwise character and due to time losses for replacement of the ballast. It should also be noted that the rollers with the ballast means of this type necessarily requires the application of hoisting equipment which are used only periodically and therefore unprofitably.

Known in the art also is a road roller with pneumatic rolls which rolls define, in combination with any one of the above-described ballast means, posseses evident advantages as compared to the conventional ballast means. The essence of the device consists in that a pneumatic roll comprises a number of coaxially arranged wheels with inflatable tires, the interiors of these tires being communicated with a gas compressor plant through a common gas distribution system. This makes it possible to inflate the tires with the gas or to release it therefrom during the operation, thereby changing the surface of contact between the tire and the pavement being treated with the resultant control of unit pressure onto the pavement. An increased pressure in tires leads, in particular, to an increase in unit pressure acting on the pavement, as the contact surface of the tire in this case is less than that with the reduced pressure within the tires. The disadvantage of the road rollers of this type consists mainly in that the surface of contact between the tire and the pavement cannot be adjusted in a wide range. Therefore, it is necessary to have recourse to ballasting by varying the weight of the roller. In addition, the complexity of the gas supplying system for tires makes it impossible at present to widely use the rollers with such type of ballasting means, in spite of their advantages in comparison to other known devices. Road rollers with smooth-surface rolls, which in a sense are similar to pneumatic rollers in principle in their operation, comprise rollers having a ballast unit which is movable with respect to the chassis frame, e.g. it may be mounted on a carriage shiftable along the frame thereby varying the ballast position on the chassis and controlling the unit pressure on the rolls by redistributing the load applied to the latter. The road roller of this type has not gained wide acceptance due to its complex design, low efficiency and narrow range for adjustment of working pressure. For reason of the foregoing review of the existing ballast systems it is possible to summarise their disadvantages as consisting in:

an increased weight of the rollers due to heavy ballast means which in turn leads to an excessive consumption of metal. The increased weight leads to increased power consumption of rollers;

the necessity of using auxilliary transport and hoisting equipment for transportation of rollers from one working site to another, since the modern road rollers are not suited to pass great distances due to its low driving speed dictated by technological demands. However, if the roller is made with the capacity to propel for great distances, it would cause to an extraordinary consumption of fuel and to a premature wear of the mechanisms owing to the heavy weight of modern rollers;

Great variety of types of rollers classified by weight which, in principle, stems from the necessity to ballast in a wide range. This feature is a barrier to the effective unification of units;

low quality of the pavement being produced, since the conventional road rollers do not provide a continuous and uniform increase of the load which, in fact, is applied in a stepwise manner even in case of a road roller with pneumatic rolls;

the lack of any attempt to automatically control the ballasting operation depending on the rate of compaction.

An object of the present invention is to improve the quality of pavements.

Another object of the present invention is to reduce the production cost of pavements.

Still another object of the present invention is to reduce the amount of metal consumed for the structure of road rollers.

The above objects are achieved due to the fact that in a road roller comprising a chassis with compacting rolls and ballast means, according to the present invention, the ballast means is provided with a chamber made of gasproof material, said chamber being open from one side thereof and arranged so that said open side of the chamber during the operation is covered by the pavement being compacted thereby sealing this chamber against the embient atmosphere, the interior of the chamber communicating with a source of vacuum, whereas the end wall of the chamber is connected to the chassis so that, when the vacuum is induced in the chamber, forces are transmitted from the end wall of the chamber to the chassis.

The structure of the road roller of the present invention enables one to give up the traditional concept of loading the roller by a weight ballast or specially weighted units of the roller. The present invention makes it possible to reduce the weight of the road roller which structure in this case is calculated only from the strength point of view. The ballast means of the invention ensures uniform loading of the pavement being compacted due to adjustment of degree of rarefaction in the chamber which is achieved by changing in a wide range the output of the source of vacuum. The adjustment of vacuum in time relationship and hence of the force applied onto the pavement may be performed according to any preselected law including the exponential one which has not been previously achieved. This feature makes it possible to appreciably improve the quality of the pavement being produced. Furthermore, the invention provides favourable conditions necessary to reduce the nomenclature of road rollers produced by industry and makes it possible to increase the rate of standardizing the road roller units with the resultant increase in production of the road rollers.

It is expedient to provide the end wall of the chamber facing the pavement with a sealing member made of gasproof material. This sealing member enables one to reduce penetration of air into the chamber thereby reducing the energy consumption required for the source of vacuum.

It is advantageous to connect the bottom of the chamber to its walls by means of a flexible sealing member made of a gasproof material.

Such a connection of the bottom to the walls makes it possible to maintain a constant gap between the peripheral edges of the chamber and the pavement being treated, the amount of this gap being independent of oscillations of the roller in a vertical direction. In addition, such an arrangement of the chamber aids in more efficient use of the source of vacuum.

It is advisable also to provide the chassis with longitudinal guides rigidly connected thereto, and with a carriage mounted on these guides and carrying the chamber, whereby in the course of movement of the road roiler the chamber is kept stationary with respect to the pavement being compacted.

The above structure of the ballast means makes it possible to practically eliminate the gap between the chamber and the pavement thereby preventing penetration of air into the chamber with the resultant increase in efficiency of the source of vacuum being used.

According to one embodiment of the invention, the ballast means is provided with a number of chambers having carriages connected in a chain in series with each other and with a guide mounted on the chassis and adapted to guide said carriages to move the chambers along a preselected pathway.

The disadvantage of the ballast means of the above structure consists in that it is possible with the minimum output of a source of vacuum, to gain an increased ballast force, which is multiple to the number of chambers engaging the pavement, without limiting the working length of the road roller. This ensures continuous movement of the roller along the strip of the pavement being compacted.

One enbodiment of the invention consists in that the ballast means is provided with an endless band of a flexible gasproof material interconnecting all of the chambers and serving as a sealing member for these chambers.

Such interconnection of the chambers makes it possible to organize the movement of plurality of chambers along the guides of the chassis thereby ensuring exact distances therebetween and hence a predetermined sequence of contact between the chambers and the pavement being compacted with the resultant stabilization of the load acting upon rolls of the road roller. Furthermore, this band at the same time serves as a sealing member for all of the chambers thereby enabling one to dispense with individual seals for the chambers, which seals require special adjustment.

It is further expedient to provide the source of vacuum with a distributing device in the form of a cylindrical reservoir communicating with to the source of vacuum and also with a ring-like ferrule embracing said reservoir so as to be rotated therearound, the cylindrical wall of the reservoir being provided with a through slot, whereas pipe unions are mounted in the lower portion of said ferrule opposite the slot, these pipe unions being connected via pipelines to the chambers. The size of the slot in the cylindrical reservoir is chosen depending on the number of chambers engaging the pavement.

Such an arrangement of the device makes it possible to eliminate the system with individual and selected connection of chambers to the source of vacuum. Thus, the invention solves the problem of the automatic sequential connection of a number of chambers engaging the pavement to be compacted to a vacuum source. Apart from the aforementioned, this system increases the efficiency of the source of vacuum which in this case feeds only those of chambers that are in contact with the pavement, whereas inoperative chambers are disconnected from the source of vacuum.

Other objects and advantages of the present invention will be readily apparent from consideration of the following detailed description taken in conjunction with the accompanying drawings, wherein.

Figure 1:
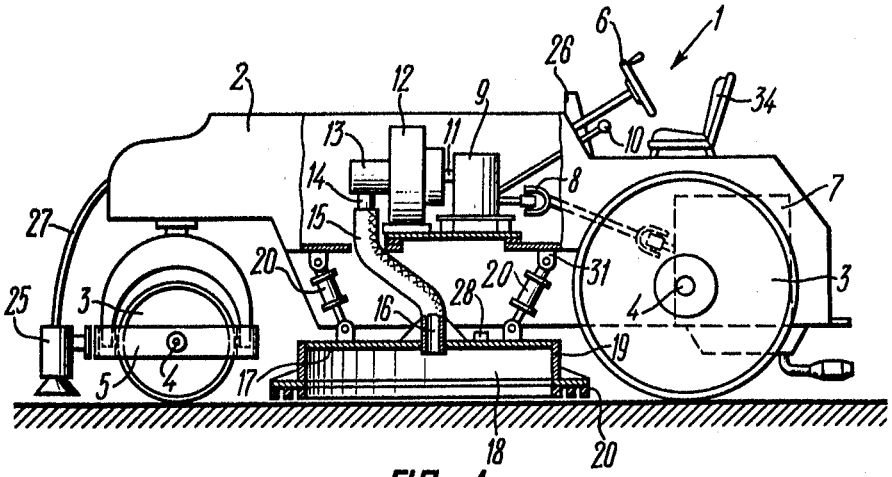
FIG. 1 is a general view of a road roller of the invention for compacting pavements.

A road roller 1 for compaction of pavements (FIG. 1) comprises a chassis 2 made in the form of a three-dimensional welded frame serving to mount thereon all the main units of the roller and connected through buffers (not shown in the drawings) to compacting members such as smooth cylindrical rolls 3 mounted on shafts 4. The ends of the shaft 4 of the forward roll 3 are supported in a swivel frame 5 which is connected through link rods (not shown in the drawings) to a steering wheel 6 disposed in a driver's cabin. The rearward roll 3 is a driven one which is connected through a transmission unit (not shown in the drawings) to an internal combustion engine located in the vicinity of this roll 3 on the chassis 2. The engine 7 through a universal-joint shaft 8 is connected to a speed-change box 9 with a shift lever of this box being located in the driver's cabin. An output shaft 11 of the speed-change box 9 is rigidly connected to an axle (not shown in the drawings) of a centrifugal blower 12 which is used as a source of vacuum. An inlet pipe 13 of the blower 12 through an adapter 14, flexible hose 15 and an adapter 16 attached to an end wall 17 of a chamber 18 of the ballast means is communicated with the interior of the chamber 18.

The chamber 18 has the form of a turned-over cup with a side wall 19 provided at the end face thereof with a sealing member 20 such as a labyrinth seal.

The member 20 comprises a set of rings 21 of different height made of resilient material and arranged coaxially with respect to a common disk member 22 (FIG. 2) mounting said rings and being connected to the wall 19 of the chamber 18. The different height rings 21 of the sealing member 20 define a typical labyrinth packing. It should be noted in this connection that the chamber 18 is made of a gasproof material, and preferably from steel, facilitating interconnection between the chamber 18 and the remaining units of the road roller 1. The shape of the chamber 18 in a plan view is of no importance and may be of any required form (square, rectangular, oval, etc.).

The chamber 18 by means of piston rods 23 of hydraulic cylinders 24 is pivotally connected to the chassis 2. The main purpose of the hydraulic cylinders 24 resides in the transmission of a force from the chamber 18 to the chassis 2 through these cylinders with the ballast means in a working position, i.e. when the chamber 18 is arranged over the pavement and evacuated. The hydraulic cylinders 24 are controlled from the driver's cabin by means of a hydraulic pump which is communicated with chambers of the hydraulic cylinders 24. The hydraulic pump and its pipelines are not shown in the accompanying drawings.

The hydraulic cylinders are also used to raise the chamber 18 in vertical direction which is associated with transportation of the road roller both by self-propelling or on a trailer, i.e. in any inoperative position of the ballast means. The swivel frame 5 of the forward roll 3 mounts a contactless sensor 25 which is responsive to a temperature of the pavement material being treated. This sensor 25 is made in the form of an infrared radiometer which is electrically connected through a cable 27 to a control unit (not shown) disposed on a control panel 26 in front of the driver.

A throttle valve 28 is provided on the external side of the end wall 17 of the chamber 18. This valve communicates the chamber 18 with the atmosphere. The valve is made in the form of a cylindrical sleeve 29 (FIG. 2) having an opening 30 accommodating a slide valve 31 formed integrally with a core (not shown) of an electromagnet 32.

A scale (not shown) of the pavement temperature sensor 25 and a scale (not shown) indicating the position of the slide valve 31 are placed on the control panel 26. Both scales are correlated with respect to each other and calibrated in centigrades, i.e. at a given temperature of the pavement material the slide valve 31 should be shifted within the sleeve 29 for a distance corresponding to the value of this temperature.

It should be noted that in the embodiment described in this specification the ballast means is controlled manually. However, it is quite possible to provide an automatic system to control the position of the slide valve 31 from the sensor 25.

This specification does not describe the structure and operation of separate units of the road roller 1 which are well known and comprise a hydraulic drive, speed-change box 9, steering mechanism, etc.

The road roller is operated under control of a driver occupying a seat 34.

The road roller for compacting pavement according to the invention operates in the following manner.

Pavement mixture heated up to 140° – 160° C is applied and uniformly levelled, e.g. by means of asphalt spreader distributing the mixture, over the surface of the future road which initially comprises a road bed prepared of broken stones.

Then the road roller comes into operation carrying out preliminary rolling under the action of its weight only without the use of the ballast means. When the sensor 25 detects that the temperatures of the pavement has reached a predetermined limit value requiring application to the pavement of a greater force than the weight of the road roller proper, the driver by means of the hydraulic cylinders 24 lowers the chamber 18 downward either to the direct contact with the pavement or to a gap of 1 – 1.5 mm with respect thereto. Further, in the above-described manner the driver sets the slide valve into position corresponding to the commencement of compaction and connects by means of the lever 10 the change-gear box 9 to the engine 7 thereby interconnecting the engine 7 and the centrifugal blower 12. The latter begins to rotate and operates with the maximum output thereby sucking air from the chamber 18 through the inlet pipe 13, adapters 14 and 16 and flexible hose 15. The blower is chosen so as to compensate for an air flow through the gas between the pavement and the flexible sealing member 20 and to create, with the completely shut-off valve 28, the pressure in the chamber 18 within the range of 0.1 – 0.2 at. Under this conditions, an excess unit pressure onto the end wall 17 of the chamber 18 will be within the range of 0.8 at/cm$^2$ – 0.9 at/cm$^2$ which makes it possible to obtain with the end wall surface of 1 m$^2$ the ballast force from 8 to 9 t. With twice as much area of the end wall 17, the ballast force will comprise respectively from 16 to 18 t, etc. On the other hand, at the initial stage of the ballast means operation, when the temperature of the mixture is at maximum, the ballast forces should be at minimum. This may be achieved with the use of the valve 28 throttling an air flow passing through the openings 30 on the sleeve 29 into the chamber 18. With this throttling, it is possible at the initial stage of operation and without alteration of the blower output to obtain vacuum in the rate of 0.95 – 0.98 at and smoothly or in considerable time intervals to bring the pressure in the chamber 18 up to 0.1 – 0.2 at which, as it has been shown above, corresponds to the pressure in the chamber 18 with the completely shut-off valve 28.

Thus, while compacting the pavement, the driver constantly watches indications of the sensor 25 and adjusts the position of the slide member 31 in the valve 28 in accordance with the variations in the temperature of the pavement, this adjustment being performed by shutting-off the flow of air into the chamber 18 thereby increasing the rate of vacuum in this chamber.

When the temperature of pavement reaches the predetermined minimum level of 40° – 60° C, the ballast means comes into operation in the manner described above with the application of the maximum pressure onto the pavement, this action being interrupted by the driver who disconnects the air blower from the engine 7 at the required moment, when the compaction has been completed.

Then the road roller 1 is moved to a new strip of the future road and the cycle is repeated.

The end wall 17 and the side wall 19 of the chamber 18 may be made movable with respect to each other. In this case it is preferable to interconnect them by means of a flexible U-shaped member 35 in the form of a sealing element made of a gasproof material such as rubber.

It is possible, with the above arrangement of the chamber 18, to eliminate a gap between the chamber 18 and the pavement during operation of the road roller 1 with the ballast means of the invention. The provision for movable interconnection between the end wall 17 and the side wall 19 of the chamber 18 enables one to distribute two main functions of the chamber 18 between the parts thereof, i.e. the end wall 17 takes the ballast load, whereas the wall 19 tightly engages the surface of the pavement irrespective of the position of the end wall 17.

Figure 4:
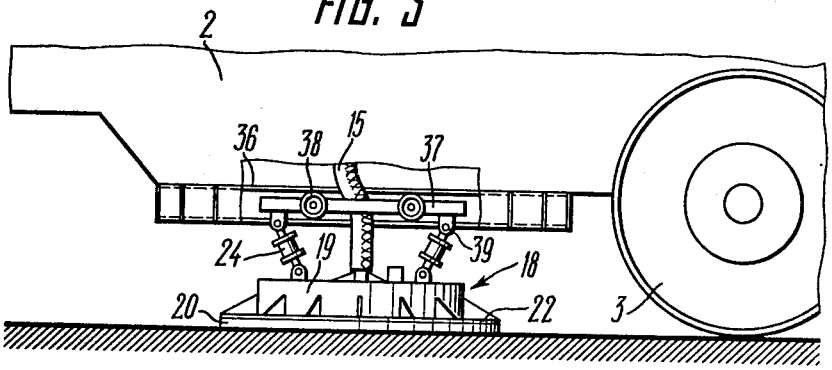
FIGS. 4, 5 illustrate a chamber with a carriage mounted in the guides.
Figure 5:
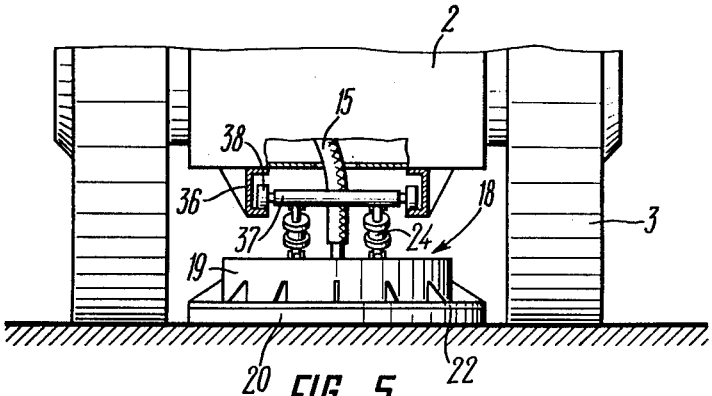

It is suggested, according to one embodiment of the invention, to provide the movable interconnection between the chamber 18 and the chassis of the road roller 1. To this end, a pair of guides 36 in the form of confronting channels is attached to the lower portion of the chassis 2 (FIGS. 4 and 5), flanges of said channels serving as guides for a carriage 37 provided with support wheels 38.

The hydraulic cylinders 24 are fixed in lugs 39 mounted on the carriage 37 and in the chamber 18. The function of the hydraulic cylinders 24 is kept the same as for embodiments shown in FIGS. 1, 2 and 3.

Upon creating vacuum in the chamber 18, the latter is sucked to the surface and transmits through the carriage 37 a force to the chassis and hence to the rolls 3 of the road roller 1.

In the course of movement of the road roller 1 over the pavement the chamber 18 remains stationary while its carriage 37 slides along the guides 36 of the chassis 2.

When the carriage 37 reaches the end of the guides 36, the driver switches off the blower 12 and opens the valve 28 thereby communicating the interior of the chamber 18 with the atmosphere and establishing in this chamber an atmospheric pressure. Then the chamber is mounted in a new position with the location of its carriage 37 at the end of the guides 36 closest to the forward roll 3 of the road roller 1. After this, the driver switches on the air blower 12 with the continuation of the operation in the manner described above.

Figure 2:
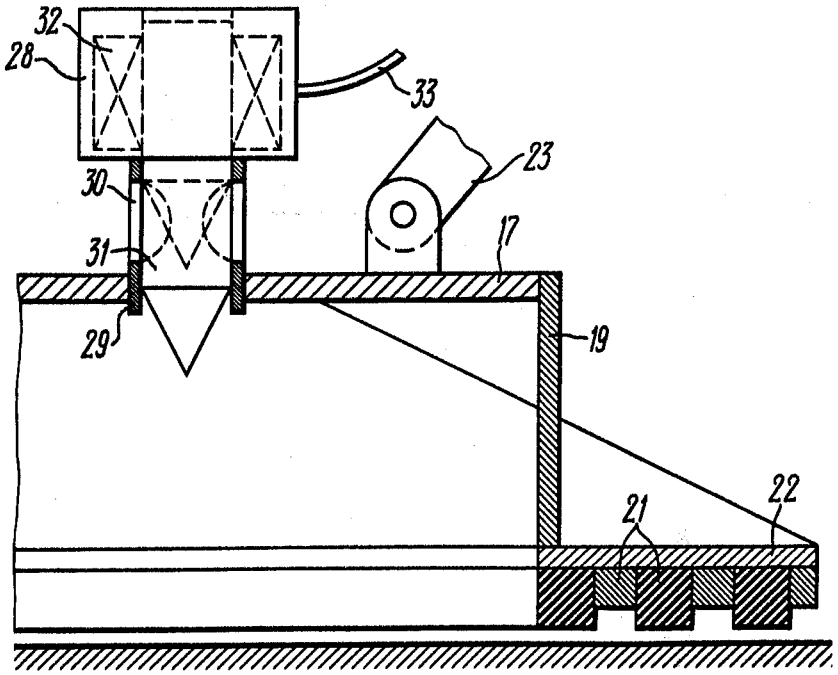
FIG. 2 is a partial cross-sectional view of a ballast means chamber.
Figure 3:
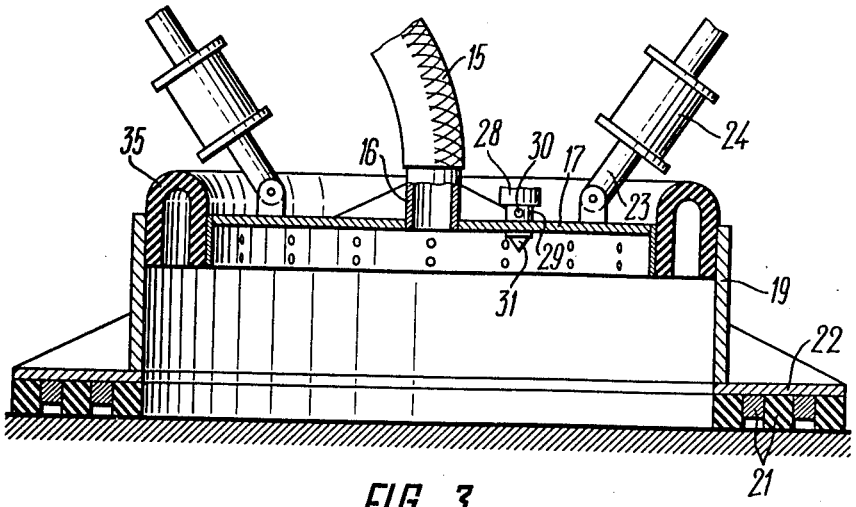
FIG. 3 is a cross-sectional view of a chamber in the ballast means of the invention.
Figure 6:
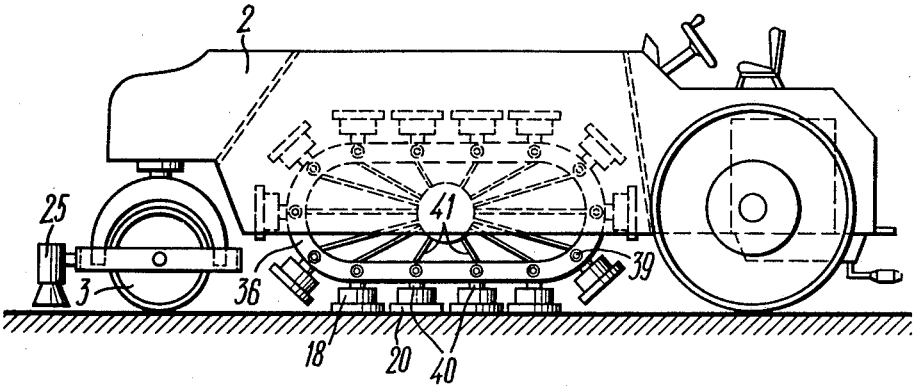
FIG. 6 is a general view of a roller with ballast means composed of a number of chambers mounted in endless guides.

FIG. 6 illustrates an embodiment wherein a ballast device is provided with a plurality of chambers 18 interconnected in series one after another so as to define an endless chain of chambers 18. It should be noted in this respect that the chambers in this case may have the same configuration as shown in FIGS. 1, 2, 3. Carriages 37 of these chambers 18 are mounted in an oval-shaped guide. The shape of the guide 36 depends on a required path for movement of the chambers 18. This embodiment involves some modification of carriages which should have the number of wheels reduced in half with location of axes 39 of these wheels 38 in brackets 40 rigidly fixed to the end wall 17 of the chambers 18. Flexible hoses 41, equal in number to that of chambers 18, communicate the latter with the source of vacuum.

Figure 7:
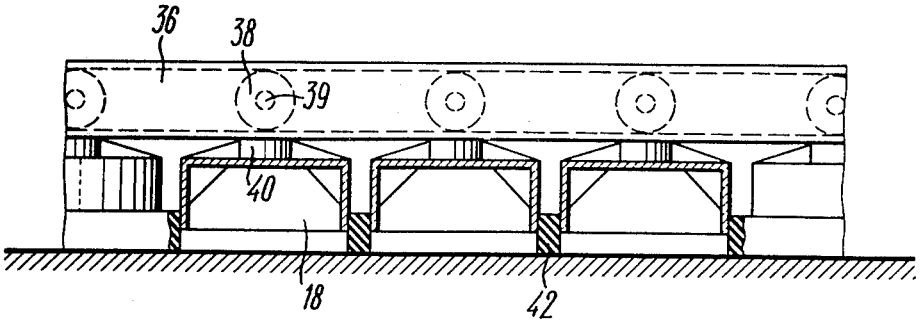
FIG. 7 is an embodiment of interconnection between the chambers.

All the chambers 18 may be mounted on an endless belt 48 (FIG. 7) made of a gasproof elastic material, this belt at the same time serving as a common sealing element for all the chambers 18.

The road roller 1 illustrated in FIG. 6 operates as follows.

When vacuum is induced in the chambers 18 engaging the pavement, the guide 36 is loaded under the action of the atmospheric pressure applied to the end walls 17 of the chambers. This source is transmitted to the chassis 2 of the road roller 1.

In the course of movement of the road roller 1 the carriages 37 slide in the guide 36 which is moved along with the chassis 2. When the chambers 18 reach the end of the lower horizontal portion of the guide 36, they are disconnected from the source of vacuum, whereas the chambers coming to this portion of the guide 36 from the opposite side are connected to the source of vacuum, i.e. to the air blower 12.

Thus, a continuous transposition of the chambers 18 occurs in the course of movement of the road roller 1, these chambers 18 engaging the pavement under the action of vacuum being sucked to the pavement and remaining stationary during the movement of the road roller 1.

Taking into consideration the provision of plurality of chambers 18, their interconnection through the endless belt 42 and closed pathway for movement of the chambers formed by the guide 36, one can imagine the sequence of movement of the chambers which pass from the upper horizontal run of the quide 36 to the lower horizontal portion thereof and then upon engagement with the pavement come in communication with the source of vacuum. The best analogy to the principle of operation of the above-described ballast means is movement of track shoes of a caterpillar drive with the difference that chambers 18 perform the function of track shoes in case of the ballast device.

Figure 8:
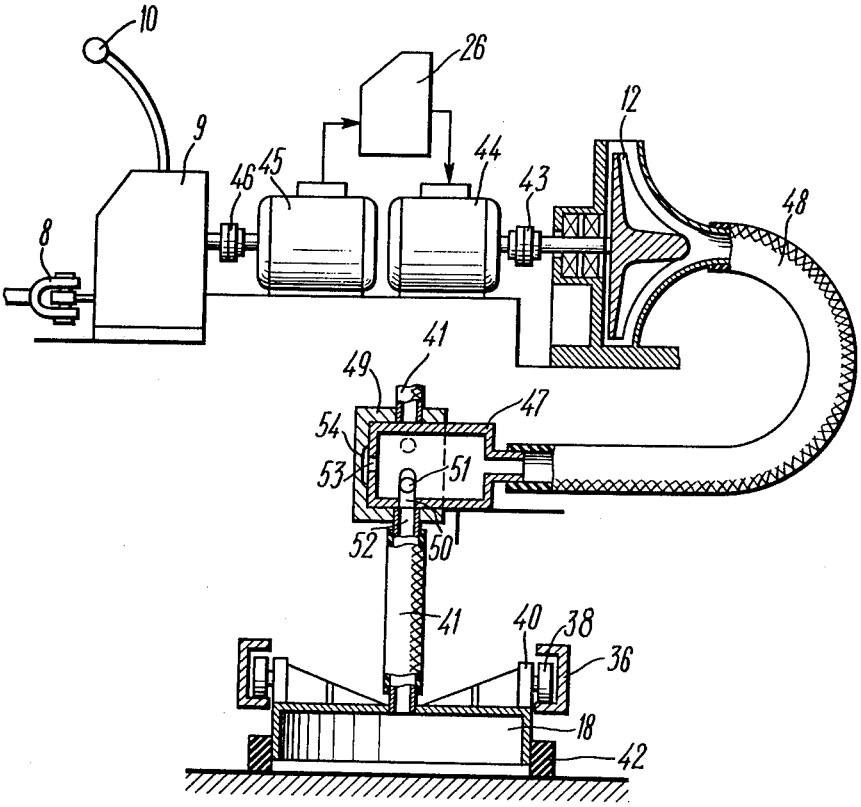
FIG. 8 illustrates a source of vacuum with a distribution system.
Figure 9:
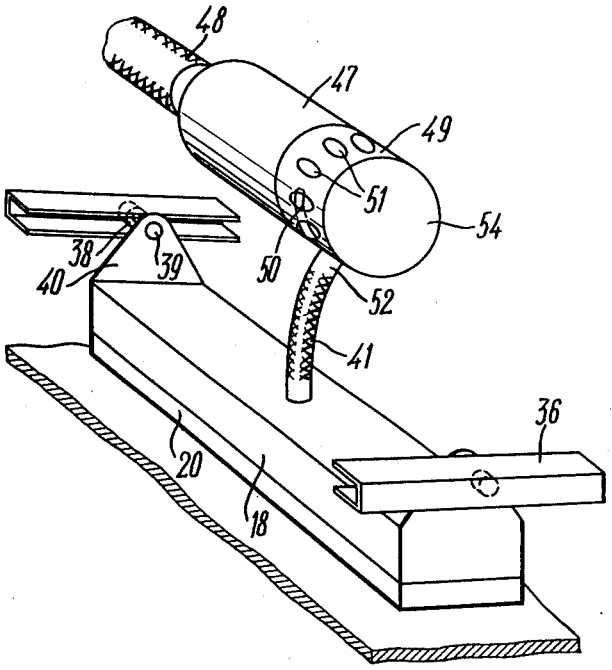
FIG. 9 is a view of the distribution system in connection with the chamber.

As it has been noted, the source of vacuum is made in the form of the centrifugal blower 12 (FIG. 8) which is connected via a clutch 43 to an electric motor 44. The electric motor 44 is connected through a control panel to a d.c. generator 45 which in turn is connected to the change-gear box 9 through a clutch 46.

A distribution device is provided to couple the chambers 18 engaging the pavement to the source of vacuum. This device comprises a cylindrical reservoir 47 communicated with the blower 12 by means of a pipeline 48.

A ring-shaped ferrule 49 embraces the reservoir 47 so as to be able to rotate thereabout.

A through slot 50 is made in the wall of the cylindrical reservoir, whereas openings 51 with pipe unions 52 inserted into each of them are provided in the cylindrical wall of the ring-shaped ferrule 49. The pipe unions 52 connect via the flexible hoses 41 the interior of the reservoir 47 with the chambers 18. There is a window 53 in the bottom wall of the reservoir 47, said window being arranged near the bottom 54 of the ring-shaped ferrule 49. The latter is held on the reservoir 47 due to atmospheric pressure acting upon the bottom 54 having an area equal to that of the window 53.

The above-described distribution device operates in the following manner. The generator 45 is connected to the internal combustion engine 7 through the change-gear box 9 and the clutch 46. Current produced by the generator 45 is controlled at the control panel 26 and fed to the electric motor 44 which switches on the blower 12 via the clutch 43. Air through the pipeline 48 is evacuated from the cylindrical reservoir 47 and then via the latter, from the chambers 18 through the slot 50, openings 51, pipe unions 52 and flexible hoses 41. In consequence, the chambers are loaded by the atmospheric pressure. The air blower 12 evacuates air only from those chambers 18 which are in contact with the pavement. The order of this contact in turn is determined by interrelationship between the slot 50 and the openings 51 in the ring-shaped ferrule 49. The reservoir 47 is connected through the slot 50 and the openings 51 only to those of chambers 18 that have come into contact with the pavement. The remaining chambers which are not in contact with the pavement in this case will be sealed against the continuous cylindrical wall of the reservoir 47.

Coincidence of the openings 51 with the slot 50 is performed automatically in the course of movement of the chambers 18 which by means of the flexible hoses 41 drive the ring-shaped ferrule 49 rotating it around the cylindrical reservoir 47.

What we claim is:

1. A road roller for compacting a road comprising: a chassis; at least one compacting roll mounted on said chassis; ballast means connected to said chassis and provided with a source of vacuum and at least one chamber, said chamber having side walls and being open at one side and having a bottom wall at the other side which is connected to said chassis, said chamber communicating with said source of vacuum and arranged so that in the course of operation said open side of the chamber is covered by the road being compacted, said bottom wall of the chamber being connected to the chassis so that, when the vacuum is induced in the chamber, forces are transmitted from the bottom wall of said chamber to the chassis.

2. A road roller according to claim 1, a sealing member mounted at the end face of the chamber facing the pavement, said sealing member being of gasproof material.

3. A road roller according to claim 1, including a flexible sealing member connecting the bottom wall of the chamber to the side wall, said flexible sealing member being of gasproof material.

4. A road roller according to claim 1, including at least one longitudinal guide means mounted on said chassis and rigidly connected thereto and a carriage mounted on said guide means and carrying a chamber whereby in the course of movement of the road roller the chamber is maintained stationary with respect to the road being compacted.

5. A road roller according to claim 4, wherein the ballast means is provided with a plurality of chambers with associated carriages connected in series with respect to each other and defining an endless chain, said ballast means having a guide mounted on the chassis so as to guide said carriages for moving the chambers along a predetermined path.

6. A road roller according to claim 1 wherein the ballast means is provided with an endless belt of gasproof elastic material, said belt interconnecting all the chambers and serving as sealing means for all the chambers.

7. A road roller according to claim 1 including a distributing device for said source of vacuum, said distribution device comprising a cylindrical reservoir communicating with the source of vacuum and a ring-shaped ferrule embracing said reservoir so as to be able to rotate therearound, the cylindrical wall of the reservoir being provided with a through slot, conduit means mounted in the lower portion of said ferrule against said slot, and said conduit means being connected to the chambers via flexible hoses.

8. In a road roller for compacting roads having a chassis and a plurality of compacting rolls mounted on said chassis, the improvement which comprises: ballast means mounted on said chassis, said ballast means having at least one chamber and a source of vacuum for evacuating said chamber, said chamber having side-walls and being open at one end and having a bottom wall at the other end; said chamber being mounted so that the open end faces the road during the road compacting operation, means associated with said chassis and connected to said bottom wall for transmitting a force from said chamber to said chassis when said chamber is over the road and evacuated; means for connecting said chamber to said vacuum source when said chamber is in the compacting position so as to evacuate said chamber, and means for placing said chamber against the road.

* * * * *